United States Patent [19]

Akihama et al.

[11] Patent Number: 4,522,003

[45] Date of Patent: Jun. 11, 1985

[54] TILES AND ARRANGEMENT FOR SETTING TILES

[75] Inventors: Shigeyuki Akihama, Sagamihara; Hajime Koizumi, Tokyo; Yoshihiko Umeki, Kure; Makoto Saito, Kawasaki; Tadashi Banno, Fuchu; Shinya Tateno, Yokohama, all of Japan

[73] Assignees: Manten Co., Ltd., Osaka; Kajima Corporation, Tokyo, both of Japan

[21] Appl. No.: 486,542

[22] Filed: Apr. 19, 1983

[30] Foreign Application Priority Data

Apr. 19, 1982 [JP] Japan ..... 57-58075
Apr. 19, 1982 [JP] Japan ..... 57-58076

[51] Int. Cl.[3] ..... E04F 13/08; E04B 5/52

[52] U.S. Cl. ..... 52/391; 52/235; 52/489

[58] Field of Search ..... 52/483, 388, 391, 235, 52/430, 432, 512, 513, 712, 713, 489, 484, 485, DIG. 5, 344, 348, 351

[56] References Cited

U.S. PATENT DOCUMENTS

| | | | |
|---|---|---|---|
| 895,884 | 8/1908 | McLeod | 52/391 |
| 982,210 | 1/1911 | Johnson | 52/712 |
| 1,501,476 | 7/1924 | Cowan | 52/344 |
| 1,947,239 | 2/1934 | Zack | 52/391 |
| 2,081,417 | 5/1937 | Antill | 52/489 |
| 2,162,695 | 6/1939 | Boyd, Sr. | 52/513 |
| 2,303,269 | 11/1942 | Goss | 52/348 |
| 3,142,938 | 8/1964 | Eberhardt | 52/388 |
| 3,319,983 | 5/1967 | Zibell | 52/489 |
| 3,715,850 | 2/1973 | Chambers | 52/235 |
| 4,014,151 | 3/1977 | Erhart | 52/235 |
| 4,194,333 | 3/1980 | Paton et al. | 52/713 |
| 4,281,494 | 8/1981 | Weinar | 52/483 |
| 4,297,822 | 11/1981 | Rijnders | 52/489 |
| 4,312,165 | 1/1982 | Mizusawa | 52/512 |
| 4,435,935 | 3/1984 | Kim | 52/483 |

FOREIGN PATENT DOCUMENTS

| | | | |
|---|---|---|---|
| 1609503 | 3/1970 | Fed. Rep. of Germany | 52/235 |
| 2021461 | 11/1971 | Fed. Rep. of Germany | 52/235 |
| 1476222 | 4/1967 | France | 52/344 |
| 46561 | 3/1962 | Poland | 52/235 |

*Primary Examiner*—John E. Murtagh
*Assistant Examiner*—Andrew Joseph Rudy
*Attorney, Agent, or Firm*—Wenderoth, Lind & Ponack

[57] ABSTRACT

An improved tile is prevented from coming off mortar applied to the back of the tile. Anchors are engaged in dovetail grooves formed in the back of the tile. Also, an arrangement for setting tiles can prevent the tiles from coming off mortar. Hooks secured to the back of each tile are secured to horizontal beams mounted on the surface to be tiled.

5 Claims, 10 Drawing Figures

TILES AND ARRANGEMENT FOR SETTING TILES

BACKGROUND OF THE INVENTION

1. Field of the Invention

The present invention relates to a tile and an arrangement for setting tiles.

2. Description of the Prior Art

Conventionally, tiles have been set on the surface of a wall, etc., with mortar.

However, tiles and mortar are different in quality and there is a great difference in the amount of heat between the tiles which are exposed to the open air and the mortar which is covered with tiles. Consequently, a great difference results between them in the rate at which they expand or contract.

This results in a disadvantage in that the tiles are apt to come off the mortar. Loosening and falling of tiles was frequent especially in a region where the difference in temperature between day and night is extreme, because drastic expansion and contraction alternate in such a region.

Since tiles have been set on the surface of a wall with mortar, in addition to tile-setters, workers assigned for mixing the mortar was required. Further, much labor has been required to lift the mortar to a high place. Another problem is that when the tiles are set in multiple tiers in a day, those in the lower tiers are apt to come off the surface of the wall because of the load exerted by those in the upper tiers. Thus, the number of tiers in which the tiles can be set in a day was limited.

SUMMARY AND OBJECTS OF THE INVENTION

An object of the present invention is to provide a tile which will not come off the mortar even when used in hot parts of the world.

Another object of the present invention is to provide an arrangement for setting tiles. This arrangement obviates the above-mentioned shortcomings.

According to one aspect of the present invention, there is provided a tile comprising a tile body formed with dovetail grooves in a back surface thereof, and anchors adapted to engage in the dovetail grooves in order to prevent the tile from coming off the mortar applied to the back of the tile.

The present invention can avoid accidents due to the loosening and falling of tiles. The tile in accordance with the present invention is especially suited for regions where the difference in temperature is drastic between day and night.

According to another aspect of the present invention, there is provided an arrangement for setting the tiles. This arrangement comprises hooks secured to the backs of the tiles and horizontal beams secured to the surface to be tiled, the hooks having their rear ends adapted to be secured to the beams.

The arrangement for setting tiles according to the present invention obviates the necessity of applying mortar to the surface of the wall, kneading mortar, and lifting it to a high level at the job site. The arrangement also permits quick and simplified tile-setting. The number of tiers in which the tiles can be set in a day is no longer restricted.

Other objects and features of the present invention will become apparent from the following description taken with reference to the accompanying drawings.

DETAILED DESCRIPTION OF THE PREFERRED EMBODIMENTS

Figure 2:
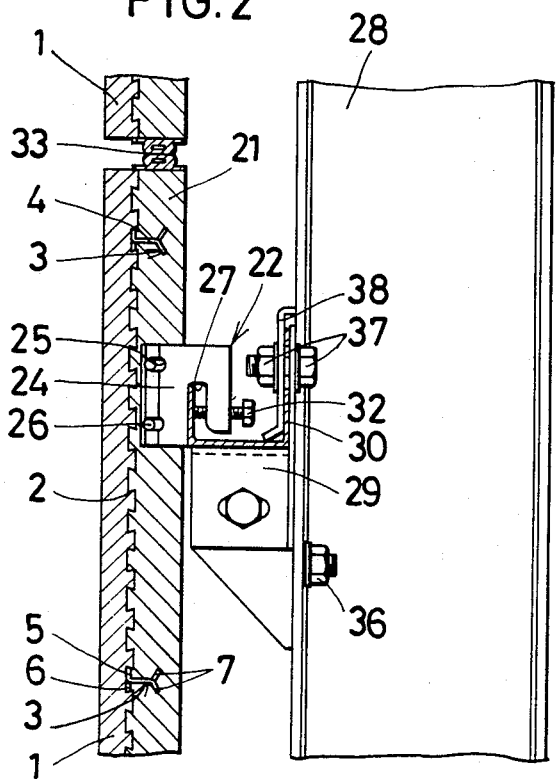
FIG. 2 is a sectional view taken along line X—X of FIG. 1.

The tile shown in FIG. 2 has a body 1 formed with dovetail grooves 2 in the back surface thereof, and anchor means 3 fitted in these dovetail grooves 2 to prevent the tile from coming off the mortar.

A plurality of hooks 22 are embedded in a layer 21 of mortar applied to the back surface of the body 1. As shown in more detail in FIG. 3, the hook 22 includes a base plate 23, side plates 24 extending from both ends of the base plate 23, and rods 26 inserted in holes 25 (FIG. 2) provided in the side plates 24. Referring to FIG. 2, the side plates 24 are formed with slots 27 extending upwardly from their lower edge, and a bolt 32 is screwed into a hole 31 (FIG. 3) provided in the base plate 23. The hooks 22 are embedded in mortar 21 for each tile in two tiers at regular intervals so as to engage horizontal beams 30 mounted on the outside surfaces of pillars 28 with some vertical spacings therebetween.

Figure 3:
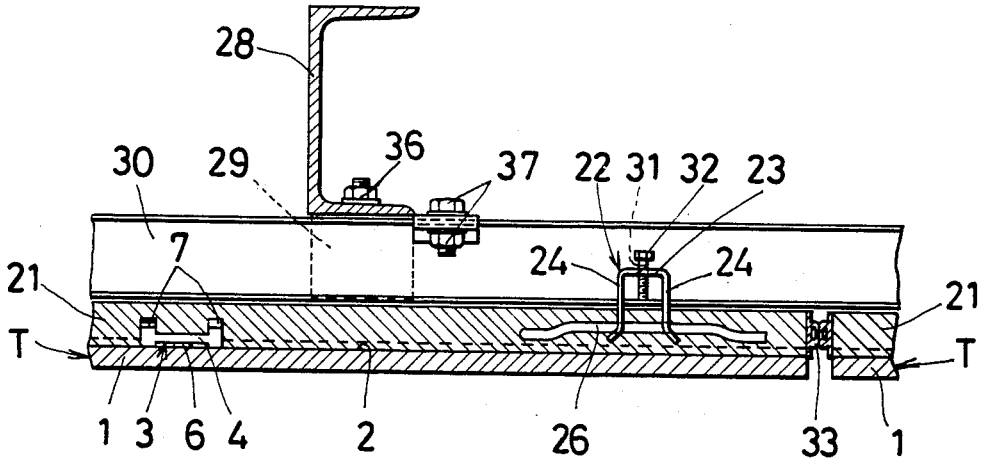
FIG. 3 is a sectional view taken along line Y—Y of FIG. 1.

In the preferred embodiment, the beams 30 are mounted as shown in FIGS. 2 and 3. First, a bracket 29 is mounted on the outside surface of each pillar 28 by a bolt-nut fastener 36. With its opening upward, the beam 30 is mounted on the brackets 29. A retaining plate 38 is tightened by a bolt-nut fastener 37 so that a vertical leg of the beam 30 will be secured between the bracket 29 and the retaining plate 38. In the alternative, the beam 30 may be mounted on the pillars 28 by other metal fittings or by welding.

Even if the tiles are exposed to strong heat, the body 1 of the tile will not come off the layer of mortar 21 thanks to anchors 3 engaged on the back surface of the body 1 of the tile (FIG. 2).

Figure 4:
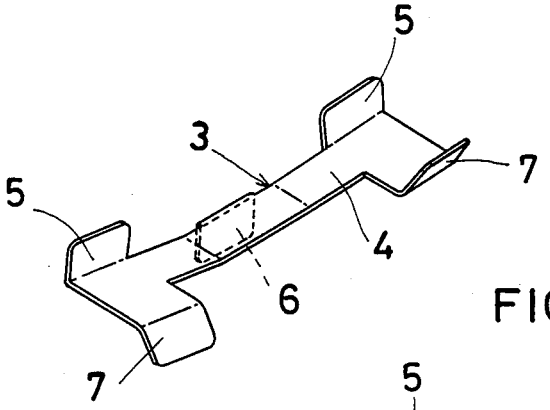
FIG. 4 is a perspective view of an example of the anchor.
Figure 5:
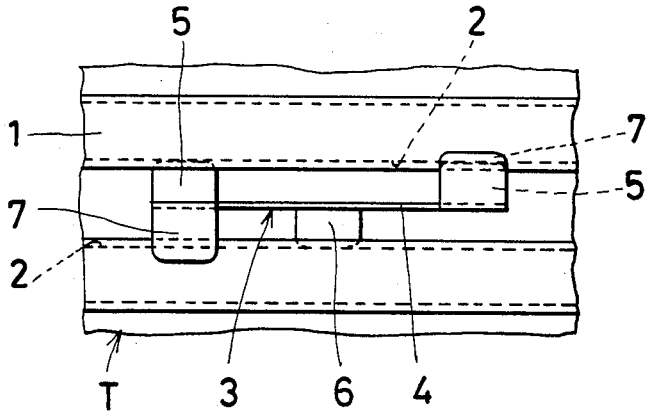
FIG. 5 is a back view of the anchor when it is fitted in a dovetail groove in the tile.
Figure 6:
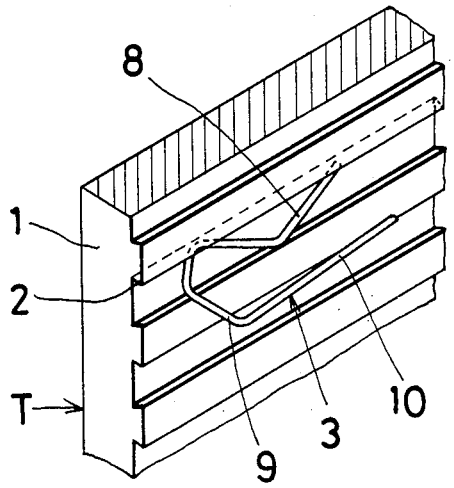
FIGS. 6 to 9 are perspective views of other examples of the anchor.

Referring to FIGS. 4 and 5, the anchor 3 comprises an elastic strip 4 with its both end portions slightly bent in the same direction. It has tongues 5 projecting in one direction from one side edge of the strip 4 at its both ends, a tongue 6 projecting in the other direction from the same side edge thereof in its middle portion, and tongues 7 projecting from the other side edge thereof in different directions. First, the tongue 5 on one end of the strip and the tongue 6 in its center are fitted in one of the dovetail grooves 2 provided in parallel arrangement in the back of the tile body 1. Then the other end of the strip 4 is pushed back resiliently in the direction in which the tongue 6 projects, and the tongue 5, provided on the other end of the strip 4, is allowed to fit in the dovetail groove 2. In such a manner, the anchors 3 are mounted in the tile body 1. Mortar 21 is then applied to the back of the tile body 1 so as to allow the bent tongues 7 of the anchors 3 to be embedded in the mortar 21.

Figure 7:
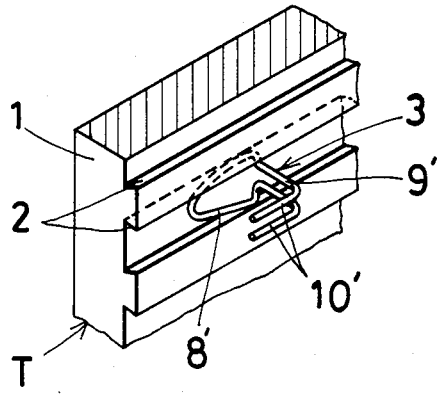
Figure 8:
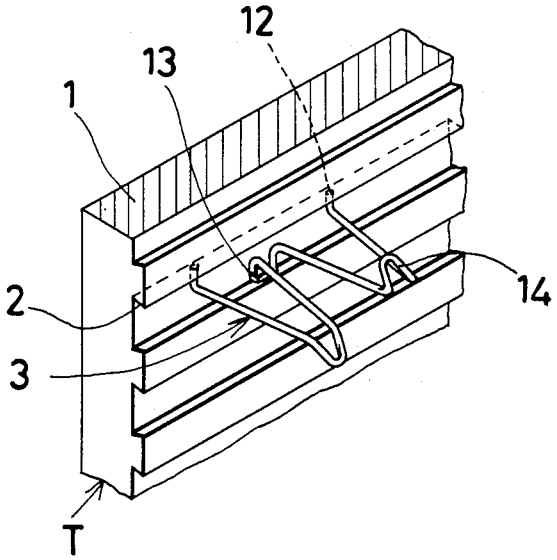
Figure 9:
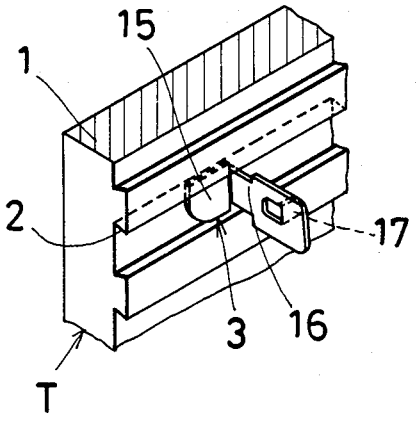

The above-described type of anchors 3 may be replaced with the one shown in FIGS. 6–9. The example of FIG. 6 comprises a wire bent so as to form a substantially shaped support portion 8, a connecting rod portion 9, and a projecting portion 10. The substantially shaped portion is adapted to be caught in the dovetail groove 2 at three points and the projecting portion 10 is adapted to be embedded in mortar 21. The third example of the anchor 3 is shown in FIG. 7. It is made of a wire and has a V-shaped support portion 8', the two prongs of which are adapted to fit in the dovetail groove 2, and projecting portions 10' spaced from the support portion 8 by connecting portions 9'. The fourth example of FIG. 8, too, is made of a wire which is bent in a W-shape with an angle vertex 13 interposed between end projections 12, said vertex 13 and end projections 12 being adapted to fit in the dovetail groove 2, and with another two bent vertices 14 provided opposite to the vertex 13 and end projections 12. The fifth example of FIG. 9 has a flange 15, the side edges of which are adapted to be caught in the dovetail groove 2 when the flange 15 is fitted therein and turned by 90°, a web 16 projecting from an end of the flange 15, and a tongue 17 provided on the web 16 either by stamping out or by bending the end of the web.

Figure 1:
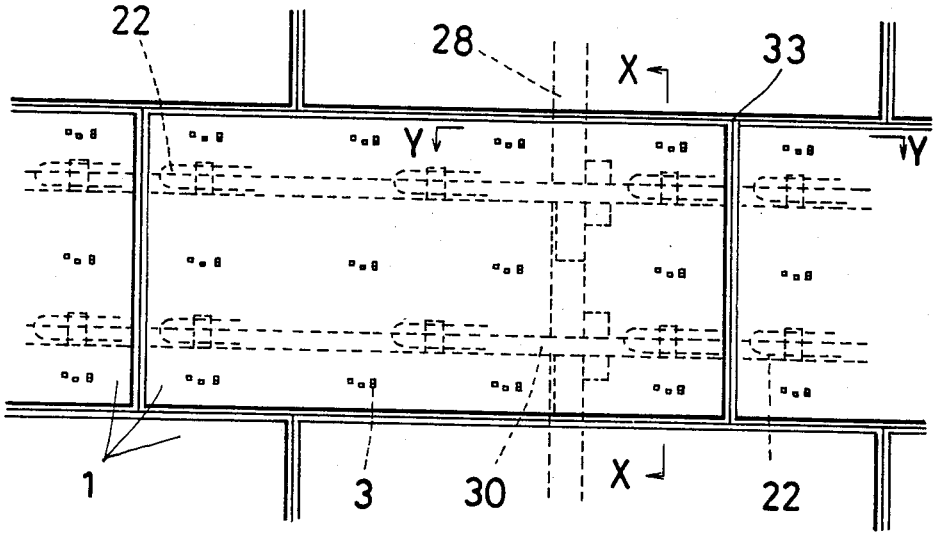
FIG. 1 is a front view of the tiles set according to the present invention.

In setting the tile of the present invention, the anchor means 3 are fitted in the dovetail grooves 2 in the body 1 of the tile in a suitable arrangement as shown in FIGS. 1 to 3. Mortar 21 is applied to the back of the tile body 1 so as to allow the anchor means 3 and the end portion of the hooks 22 to be embedded in the mortar 21.

The beams 30 are mounted on the brackets 29 secured to the outside surface of the pillars 28 and are secured to the pillars 28 by fastener 37. The hooks 22 are allowed to engage with the beam 30. The tile is secured to the beam 30 by tightening the bolts 32 screwed into the holes 31 provided in the hooks 22. In this manner, the tiles are set longitudinally and latitudinally one after another.

As shown in the drawings, the space between the adjacent tiles T is made tight by packings 33 which are bonded beforehand to their sides with an adhesive and placed against each other. In the alternative, the space between the adjacent tiles may be filled with a jointing material having a good adhesiveness.

Figure 10:
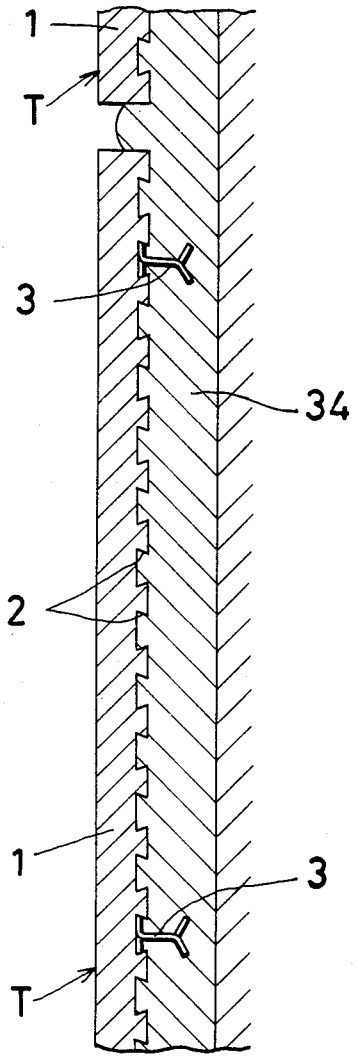
FIG. 10 is a sectional side elevation illustrating another manner how the tiles are set.

As shown in FIG. 10, the tiles may be directly set on the surface of a wall with mortar 34.

The foregoing preferred embodiments are considered illustrative only. Numerous other modifications will readily occur to those skilled in the pertinent technology. Consequently, the disclosed invention is not limited to the exact construction shown and described hereinabove but is defined by the claims appended hereto.

What is claimed is:

1. An arrangement for setting tiles on a surface to be tiled, comprising:

tiles having dovetail grooves in rear surfaces and being secured to mortar applied to said rear surfaces, a plurality of anchors engaging said dovetail grooves in the rear surfaces of the tiles and being embedded in the mortar, a plurality of hooks being partially embedded in the mortar and having rear ends projecting rearwardly out of the mortar, each of said plurality of hooks having a base plate, side plates extending from both ends of the base plate and having holes therein, and rod means, inserted into the holes in the side plates, for retaining each of the plurality of hooks partially embedded in the mortar; and horizontal beams being fixedly mounted on the surface to be tiled and having the rear ends of all of said plurality of hooks secured thereto.

2. The arrangement as recited in claim 1, wherein:

said horizontal beams have a substantially U-shape with front legs secured to all of said plurality of hooks and with rear legs secured to the surface to be tiled.

3. The arrangement as recited in claim 2, further comprising:

adjustable means, extending through the base plate, for securing the tiles to the horizontal beams.

4. The arrangement as recited in claim 4, further comprising:

bracket means, secured to the surface to be tiled, for mounting said horizontal beams thereon.

5. The arrangement as recited in claim 1, further comprising:

adjustable means, extending through the base plate, for securing the tiles to the horizontal beams.

* * * * *